US006775871B1

(12) United States Patent
Finch

(10) Patent No.: US 6,775,871 B1
(45) Date of Patent: Aug. 17, 2004

(54) AUTOMATIC FLOOR CLEANER

(76) Inventor: Edward Finch, 1435 Conservancy Dr. E., Tallahassee, FL (US) 32312

( * ) Notice: Subject to any disclaimer, the term of this patent is extended or adjusted under 35 U.S.C. 154(b) by 372 days.

(21) Appl. No.: 10/002,191

(22) Filed: Nov. 28, 2001

(51) Int. Cl.[7] ..... A47L 11/00
(52) U.S. Cl. ..... 15/49.1; 15/98; 700/245
(58) Field of Search ..... 15/49.1, 98, 319; 700/245, 258

(56) References Cited

U.S. PATENT DOCUMENTS

| | | | | |
|---|---|---|---|---|
| 3,744,586 | A | | 7/1973 | Leinauer |
| 4,173,809 | A | | 11/1979 | Ku |
| 4,306,329 | A | | 12/1981 | Yokoi |
| 4,503,581 | A | | 3/1985 | Early |
| 4,700,427 | A | | 10/1987 | Knepper |
| 4,887,415 | A | | 12/1989 | Martin |
| 5,109,566 | A | | 5/1992 | Kobayashi et al. |
| 5,284,522 | A | | 2/1994 | Kobayashi et al. |
| 5,560,077 | A | * | 10/1996 | Crotchett ..... 15/339 |
| 5,568,589 | A | | 10/1996 | Hwang |
| 5,634,237 | A | | 6/1997 | Paranjpe |
| 5,787,545 | A | | 8/1998 | Colens |
| 5,815,880 | A | | 10/1998 | Nakanishi |
| 5,995,884 | A | | 11/1999 | Allen et al. |
| 6,076,226 | A | | 6/2000 | Reed |
| 2001/0004719 | A1 | * | 6/2001 | Sommer ..... 701/23 |

* cited by examiner

*Primary Examiner*—Randall Chin
(74) *Attorney, Agent, or Firm*—Peter Loffler

(57) ABSTRACT

An automatic floor cleaner uses a body member that has a change-of-direction driving mechanism such that when the body member encounters an impediment, the direction of travel of the body member is altered. An extension extends outwardly from the body member and has a cleaning implement removably secured thereto, the cleaning implement running along the ground and cleaning same during operation of the body member.

18 Claims, 3 Drawing Sheets

AUTOMATIC FLOOR CLEANER

BACKGROUND OF THE INVENTION

1. Field of the Invention

The present invention relates to an automatic floor cleaner that randomly changes directions upon hitting an object.

2. Background of the Prior Art

Cleaning the floor, especially in the kitchen, is one of life's annoying little chores that must be performed on a regular basis in order to avoid a buildup of debris. The standard method for floor cleaning relies on sweeping the floor and thereafter running a damp cloth or a mop across the swept floor. While tried and true, this method is time consuming and labor-intensive which result in "scheduled" floor cleanings being skipped for other less onerous tasks or even for a beer and a movie depending on the circumstances.

In order to overcome the time and labor intensity associated with floor cleaning, automated floor cleaning systems have been proposed. Such systems generally fall into one of two broad categories. The first type of such system relies on various sensors and artificial intelligence in order to systematically move the floor cleaner across the floor. The sensors detect objects and other obstructions and the artificial intelligence system determines the course of action of the device with respect to the object or obstruction. Advanced devices rely on neural networks or other learning algorithms in order to understand the topography of the floor for future cleanings of the floor.

The other major type of floor cleaning system uses some form of input device so that the user can program the system in order to teach the device the various perimeters of the floor as well as any fixed obstructions so that once so programmed, the floor cleaner will be able to traverse the floor properly.

While each of the above two types of automatic floor systems work with varying degrees of speed and efficiency, depending on the particular model, such systems tend to be very complex in design and construction, making such systems uneconomical for all but a few. Additionally, the programmable model tends to be unduly difficult to set up and maintain.

Therefore, there exists a need in the art for an automatic floor cleaning system that addresses the above-mentioned concerns found in the prior art. The floor cleaning system must be relatively simple in design and construction and must be easy to setup and operate. Ideally, the floor cleaning system will be compact and lightweight and will be easy to clean.

SUMMARY OF THE INVENTION

The automatic floor cleaner of the present invention addresses the aforementioned needs in the art. The automatic floor cleaner is relatively simple in design and construction. The cleaner is very easy to setup and operate requiring either no or at best nominal programming of the device. The automatic floor cleaner is compact and lightweight and is easy to clean at regular intervals.

The automatic floor cleaner of the present invention is comprised of a body member having an extension extending therefrom. A cleaning implement is attached to or otherwise encompasses the extension. At least one ball wheel is attached to the body member while a motor is disposed within the body member. An appropriate electrical source electrically connects to the motor for operating the motor. A driven wheel is swivelly attached to the body member and is operatively attached to the motor and is a standard change-of-direction architecture (often referred to as Bump-and-Go architecture) such that when the body member is traveling in a given direction and encounters an obstacle, the driven wheel swivels and changes the traveling direction of the body member. A clip may be attached to the extension for securing the cleaning implement to the extension. A switch is electrically disposed between the electrical source and the motor and is operable between an on position establishing electrical communication between the electrical source and the motor and an off position disrupting electrical communication between the electrical source and the motor. A timer is electrically disposed between the switch and the electrical source for turning the switch to the off position after the expiration of a predetermined length of time, which length of time may be programmable. A sensor, which may be either electronic (ultrasonic transceiver, etc.), or mechanical, such as a drop latch, is attached to the body member and is electrically connected to the motor such that when the sensor senses an obstruction, the driven wheel swivels and changes the traveling direction of the body member. The cleaning implement has either static cling properties or is a wet cloth, and is made from an appropriate material such as cloth or paper.

BRIEF DESCRIPTION OF THE DRAWINGS

Similar reference numerals refer to similar parts throughout the several views of the drawings.

DESCRIPTION OF THE PREFERRED EMBODIMENT

Figure 1:
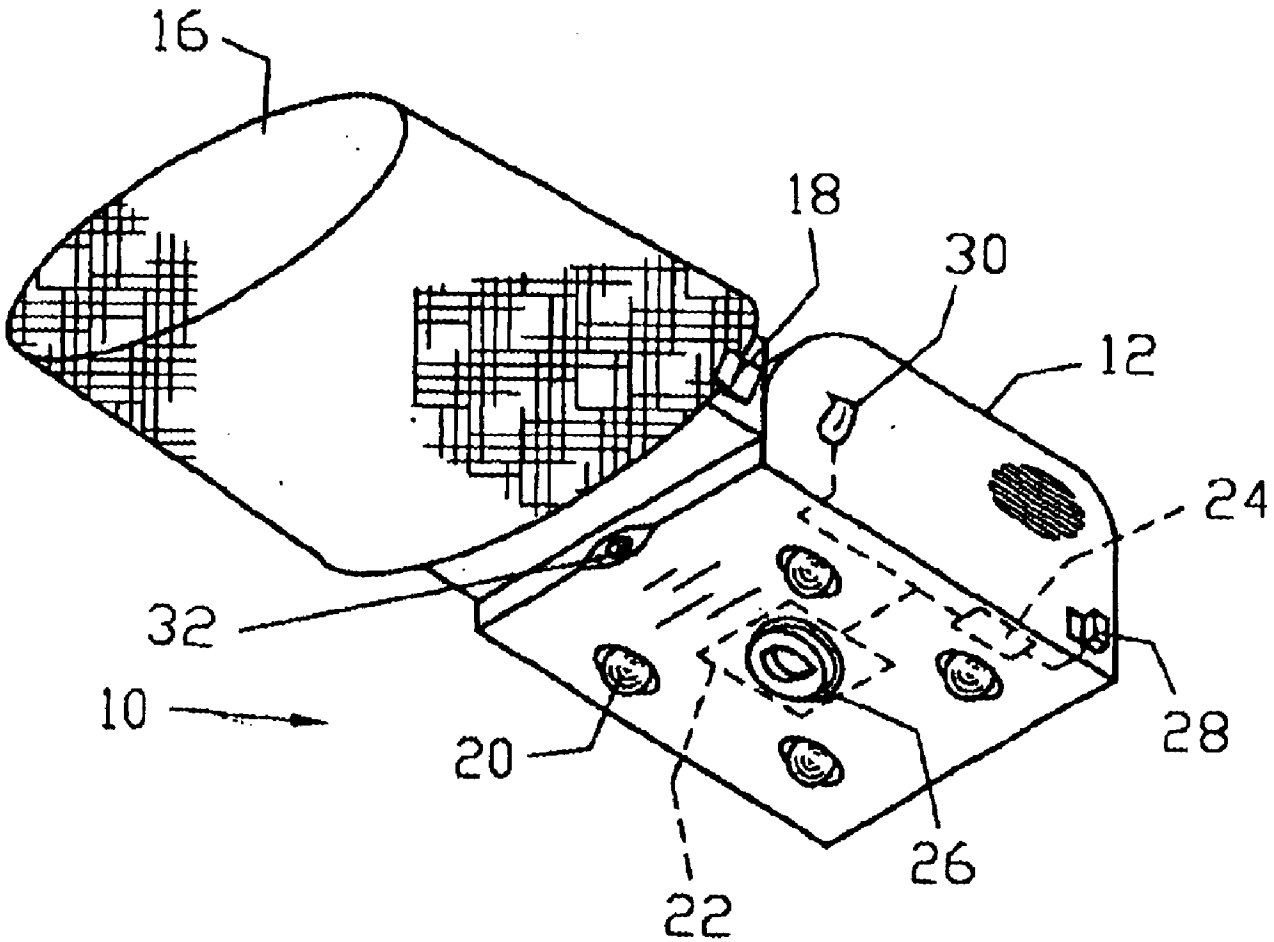
FIG. 1 is a bottom perspective view of the automatic floor cleaner of the present invention.
Figure 2:
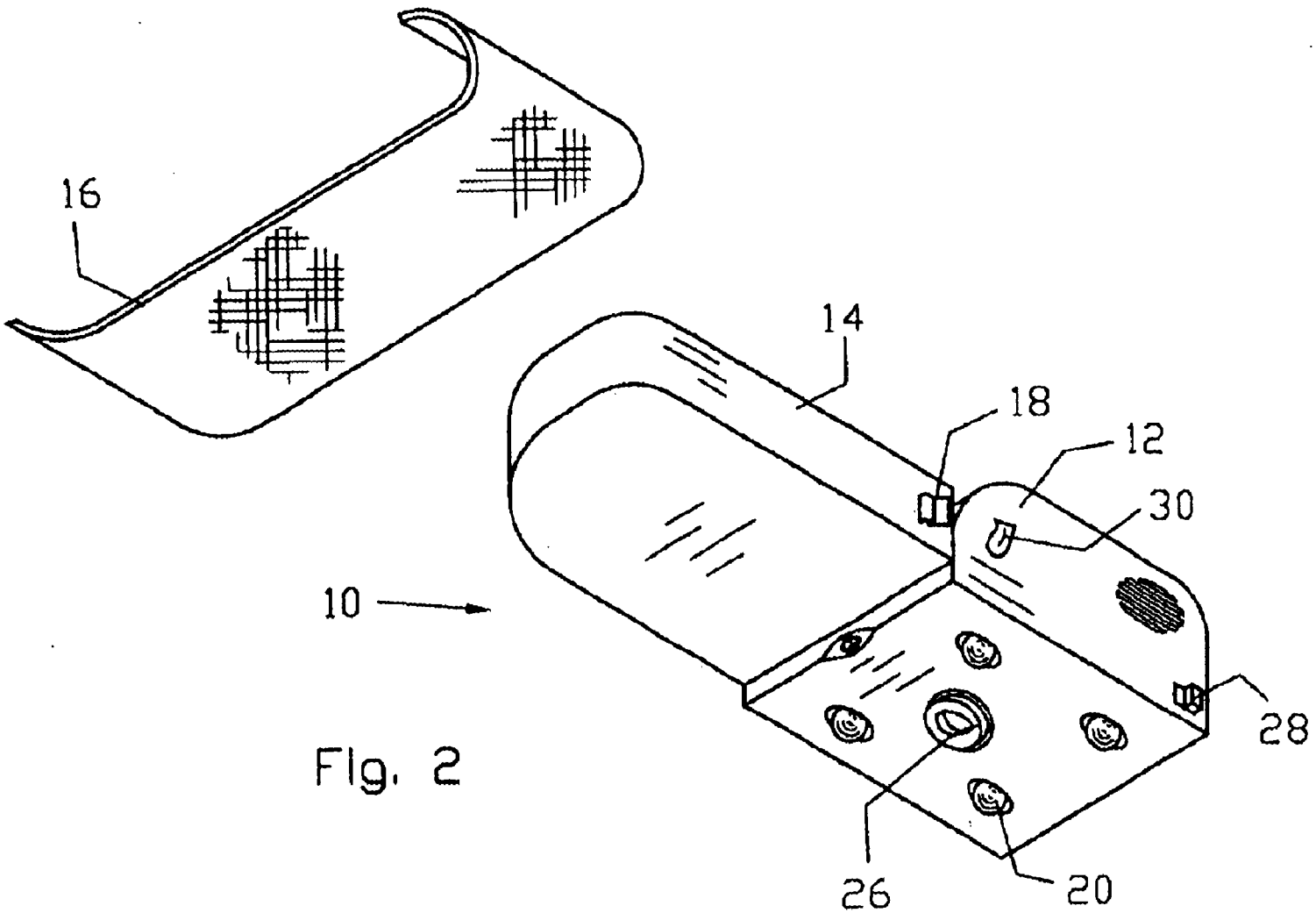
FIG. 2 is a view of FIG. 1 with the cleaning implement removed from the extension.
Figure 3:
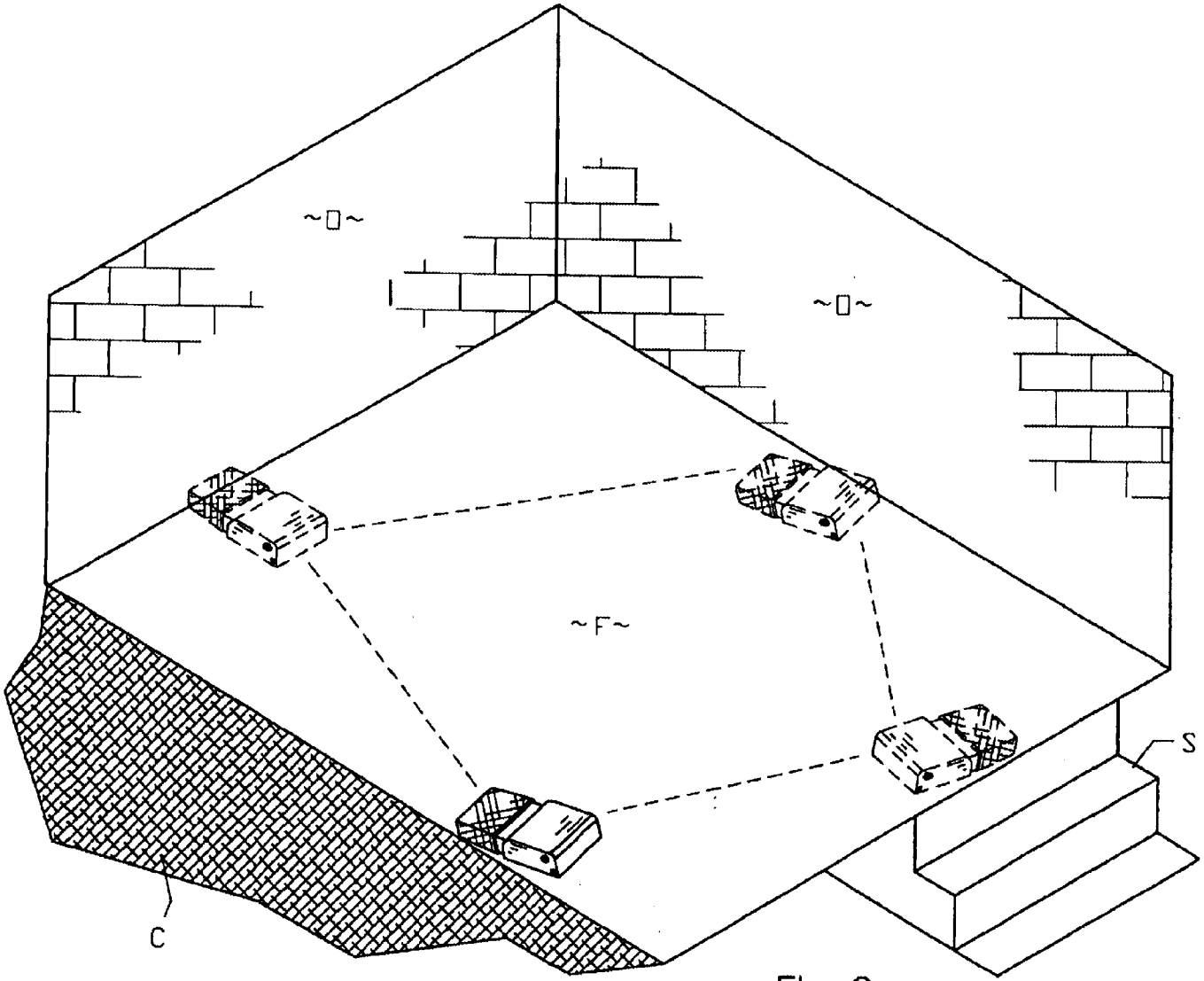
FIG. 3 is an environmental view of the automatic floor cleaner performing a cleaning task.

Referring now to the drawings, it is seen that the automatic floor cleaner of the present invention, generally denoted by reference numeral 10, is comprised of a body member 12 having an extension 14 extending therefrom. The body member 12 is made from a relatively soft material such as plastic or similar material so as not to scuff walls or cupboards during use, or appropriate resilient bumpers (not illustrated) can be attached to the sides of the body member 12. A cleaning implement 16 encompasses or is attached to the extension 14 in appropriate fashion. The cleaning implement 16 has static cling properties or is a wet cloth and is made from an appropriate material such as cloth or paper. The cleaning implement 16 can be formed as a closed cylinder, as illustrated in FIG. 1, or can be formed as a generally flat member, as illustrated in FIG. 3, that wraps around the extension 14 and the two ends of the flat member are secured to one another, or to a portion of the extension 14, the securement being by any conventional means such as using an adhesive, cooperating hook and loop materials, a clip 18, etc. The cleaning implement 16 can be impregnated with a fragrance or disinfectant. The clip 18 may be attached to the extension 14 for securing the cleaning implement 16 to the extension 14.

At least one multi-directional ball wheel 20 is attached to the body member 12 while a motor 22 is disposed within the body member 12. An appropriate electrical source 24 electrically connects to the motor 22 for operating the motor 22. The electrical source 24 can be any conventional source known in the art such as a battery that is either removable or is rechargeable. Alternately, or in addition to the battery, a solar cell (not illustrated) can be used to power the motor 22 and/or recharge the battery. A driven wheel 26 is swivelly attached to the body member 12 and is operatively attached to the motor 22 and has standard change-of-direction architecture such that when the body member 12 is traveling in a given direction and encounters an obstacle 0, the driven wheel 26 swivels and changes the traveling direction of the body member 12.

A switch 28 is electrically disposed between the electrical source 24 and the motor 22 and is operable between an on position establishing electrical communication between the electrical source 24 and the motor 22, and an off position disrupting electrical communication between the electrical source 24 and the motor 22. A timer 30 is electrically disposed between the switch 28 and the electrical source 24 for turning the switch 28 to the off position after the expiration of a predetermined length of time. This length of time may be programmable by providing an appropriate switch or dial for the timer 30 (in such an arrangement, the switch may be part of the timer assembly such that setting the timer turns the motor 22 on, and accordingly, no other external switch would be present on the body member 12). A sensor 32 is attached to the body member 12 and is electrically connected to the motor 22 such that when the sensor 32 senses an obstruction, such as a carpet C or a stair S, the driven wheel 26 swivels and changes the traveling direction of the body member 12.

In order to use the automatic floor cleaner 10 of the present invention, a cleaning implement 16 is wrapped around the extension 14 and the clip 18 (or other securement means) holds it thereat. If used, the timer 30 is set appropriately, and the switch 28 is turned to the on position. The automatic floor cleaner 10 is left on the floor F to be cleaned and the device 10 travels along the floor F with the cleaning implement 16 cleaning the floor F. As an object 0 or an obstruction C or S is encountered, the device 10 changes direction of travel. This process continues until the device 10 is manually or automatically shut off. With sufficient time, the automatic floor cleaner 10 will have randomly covered most of the floor F area thereby effecting a cleaning of the floor F.

While the invention has been particularly shown and described with reference to an embodiment thereof, it will be appreciated by those skilled in the art that various changes in form and detail may be made without departing from the spirit and scope of the invention.

I claim:

1. An automatic floor cleaner comprising:

a body member having an extension extending therefrom;

a cleaning implement attached to the extension;

at least one ball wheel attached to the body member;

a motor disposed within the body member;

an electrical source electrically connected to the motor for operating the motor; and a driven wheel swivelly attached to the body member and operatively attached to the motor such that when the body member is traveling and encounters an obstacle, the driven wheel swivels and changes the traveling direction of the body member.

2. The automatic floor cleaner as in claim 1 further comprising a clip attached to the extension for securing the cleaning implement to the extension.

3. The automatic floor cleaner as in claim 1 further comprising a switch electrically disposed between the electrical source and the motor and operable between an on position establishing electrical communication between the electrical source and the motor and the off position disrupting electrical communication between the electrical source and the motor.

4. The automatic floor cleaner as in claim 3 further comprising a timer electrically disposed between the switch and the electrical source for turning the switch to an off position after the expiration of a predetermined length of time.

5. The automatic floor cleaner as in claim 4 wherein the length of time of the timer is programmable.

6. The automatic floor cleaner as in claim 1 further comprising a sensor attached to the body member and electrically connected to the motor such that when the sensor senses an obstruction, the driven wheel swivels and changes the traveling direction of the body member.

7. The automatic floor cleaner as in claim 1 wherein the cleaning implement has static cling properties.

8. The automatic floor cleaner as in claim 1 wherein the cleaning implement is made from cloth.

9. The automatic floor cleaner as in claim 1 wherein the cleaning implement is made from paper.

10. An automatic floor cleaner comprising:

a body member having an extension extending therefrom;

a cleaning implement attached to the extension;

at least one ball wheel attached to the body member;

a motorized change-of-direction wheel attached to the body member; and an electrical source electrically connected to the motorized change-of-direction wheel for operating the motorized change-of-direction wheel.

11. The automatic floor cleaner as in claim 10 further comprising a clip attached to the extension for securing the cleaning implement to the extension.

12. The automatic floor cleaner as in claim 10 further comprising a switch electrically disposed between the electrical source and the motorized change-of-direction wheel and operable between an on position establishing electrical communication between the electrical source and the motor and an off position disrupting electrical communication between the electrical source and the motorized change-of-direction wheel.

13. The automatic floor cleaner as in claim 12 further comprising a timer electrically disposed between the switch and the electrical source for turning the switch to the off position after the expiration of a predetermined length of time.

14. The automatic floor cleaner as in claim 13 wherein the length of time of the timer is programmable.

15. The automatic floor cleaner as in claim 10 further comprising a sensor attached to the body member and electrically connected to the motor such that when the sensor senses an obstruction, the driven wheel swivels and changes the traveling direction of the body member.

16. The automatic floor cleaner as in claim 10 wherein the cleaning implement has static cling properties.

17. The automatic floor cleaner as in claim 10 wherein the cleaning implement is made from cloth.

18. The automatic floor cleaner as in claim 10 wherein the cleaning implement is made from paper.

* * * * *